US006953239B2

(12) United States Patent
Gondek et al.

(10) Patent No.: US 6,953,239 B2
(45) Date of Patent: Oct. 11, 2005

(54) PRINTER SYSTEM AND PRINTING METHOD

(75) Inventors: Jay S. Gondek, Camas, WA (US); Matthew A. Shepherd, Vancouver, WA (US); Morgan T. Schramm, Portland, OR (US); John F. Meyer, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 108 days.

(21) Appl. No.: 10/460,848

(22) Filed: Jun. 13, 2003

(65) Prior Publication Data

US 2004/0252162 A1 Dec. 16, 2004

(51) Int. Cl.[7] ..... B41J 2/21; B41J 2/175

(52) U.S. Cl. ..... 347/43; 347/86

(58) Field of Search ..... 347/15, 43, 86, 347/100

(56) References Cited

U.S. PATENT DOCUMENTS

| | | | | |
|---|---|---|---|---|
| 4,982,199 | A | | 1/1991 | Dunn |
| 5,010,354 | A | | 4/1991 | Cowger et al. |
| 5,659,345 | A | | 8/1997 | Altendorf |
| 5,754,207 | A | | 5/1998 | Gragg et al. |
| 5,764,252 | A | | 6/1998 | Burr et al. |
| 5,788,388 | A | | 8/1998 | Cowger et al. |
| 5,821,956 | A | | 10/1998 | Kroon et al. |
| 5,859,652 | A | | 1/1999 | Silverbrook |
| 5,897,789 | A | | 4/1999 | Weber |
| 5,966,150 | A | | 10/1999 | Lester et al. |
| 5,969,739 | A | | 10/1999 | Altendorf et al. |
| 5,982,992 | A | | 11/1999 | Waldron |
| 5,984,445 | A | | 11/1999 | Morita et al. |
| 5,997,132 | A | * | 12/1999 | Smith et al. ..... 347/43 |
| 6,042,211 | A | | 3/2000 | Hudson et al. |
| 6,089,691 | A | | 7/2000 | Kakutani |
| 6,099,105 | A | | 8/2000 | Kakutani |
| 6,264,300 | B1 | | 7/2001 | Warner |
| 6,270,181 | B1 | | 8/2001 | Ota |
| 6,273,560 | B1 | | 8/2001 | Keefe et al. |
| 6,325,483 | B1 | | 12/2001 | Harbour et al. |
| 6,325,487 | B1 | | 12/2001 | Mantell |
| 6,338,538 | B1 | | 1/2002 | Toshiaki |
| 6,375,308 | B1 | | 4/2002 | Shimada |
| 6,462,836 | B1 | | 10/2002 | Sato et al. |
| 6,471,426 | B1 | | 10/2002 | Shepherd et al. |
| D466,928 | S | | 12/2002 | Boyd et al. |
| 6,540,327 | B1 | * | 4/2003 | Akiyama et al. ..... 347/43 |
| 6,592,212 | B1 | * | 7/2003 | Kakutani ..... 347/86 |
| 6,783,202 | B2 | * | 8/2004 | Franzke ..... 347/15 |

* cited by examiner

*Primary Examiner*—Thinh Nguyen

(57) ABSTRACT

A printing system includes a printer and a print cartridge. The printer includes a carriage configured to move across the medium. The print cartridge is releasably coupled to the carriage and includes a first printhead and at least three achromatic inks. The at least three achromatic inks have distinct L* values and are contained within at least three chambers in communication with the printhead.

72 Claims, 1 Drawing Sheet

PRINTER SYSTEM AND PRINTING METHOD

CROSS-REFERENCE TO RELATED PATENT APPLICATIONS

The present application is related to co-pending U.S. patent application Ser. No. 10/461,951 entitled "Print Cartridge" and having the same inventors as the present application and filed on the same date as the present application, the full disclosure of which is hereby incorporated by reference.

The present application is related to co-pending U.S. patent application Ser. No. 10/460,890 entitled INTERPOLATION USING AT LEAST ONE BOUNDARY POINT IN A BOUNDARY SURFACE, filed on the same date herewith by Jay S. Gondek, Ufuk A. Agar and Morgan T. Schramm, the full disclosure of which is hereby incorporated by reference.

The present application is related to co-pending U.S. patent application Ser. No. 10/460,891 entitled RENDERING USING AT LEAST TWO LEVELS OF GRAY, filed on the same date herewith by Jay S. Gondek. Stephen W. Bauer, Matthew A. Shepherd, Guo Lee and Luann E. J. Rolly, the full disclosure of which is hereby incorporated by reference.

BACKGROUND

Various printing systems presently exist for printing color or black and white images upon a print medium such as paper. Inkjet printing systems typically include print cartridges (also known as pens) which contain ink and also include a printhead with nozzles to eject drops of ink onto a page or sheet of the print media. The print cartridges are typically mounted on a carriage which is arranged to scan across the print media along an axis as the print cartridges print a series of individual drops of ink on the print media. The series of drops collectively form a band of an image, such as a picture, chart or text. Between such scans, the print medium is advanced relative to the scan axis.

Known color inkjet printing systems typically utilize the following inks: dark cyan (C), dark magenta (M), yellow (Y), light cyan (c), light magenta (m), pigment black (k) and dye black (Z). In some systems, the C, M and Y inks are contained in a single print cartridge having three chambers communicating with a printhead. The c, m and Z inks are typically contained in a second three-chambered print cartridge. This print cartridge is often referred to as "photo" print cartridge. Because the k ink is particularly used for textual or monochrome printing, some systems additionally include a print cartridge having a single chamber containing the k ink.

Despite the many advances that have been made over the years, existing printing systems and print cartridges fail to provide consistent high-quality results when printing photos. Existing printing systems and inkjet print cartridges also fail to facilitate convenient, inexpensive printing of different image types.

DETAILED DESCRIPTION OF THE EXAMPLE EMBODIMENTS

Figure 1:
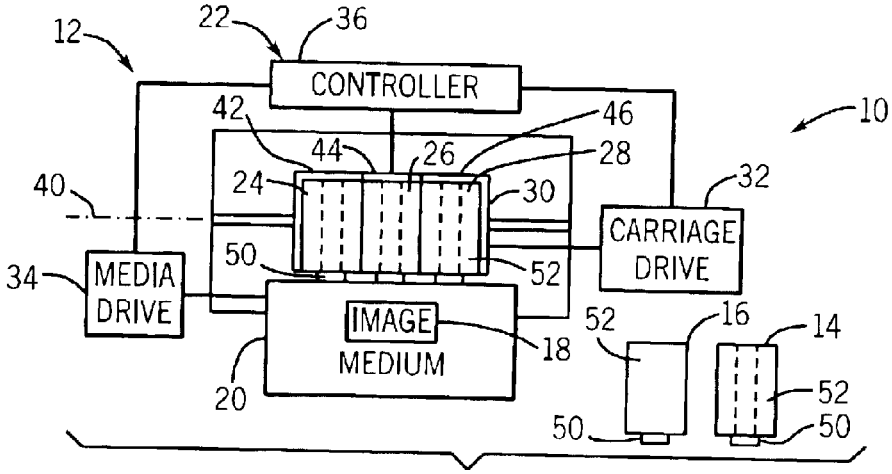
FIG. 1 is a schematic illustration of a printer kit and printing system of an example embodiment of the present invention.

FIG. 1 is a schematic illustration of a printer kit 10 which includes a printing system 12 and additional interchangeable print cartridges 14, 16. Printing system 12 is generally configured to print an image 18 upon a print medium 20. System 12 includes printer 22 and printer cartridges or print cartridges 24, 26 and 28. Printer 22 includes carriage 30, carriage drive 32, media drive 34, and controller 36. Carriage 30 generally comprises a structure configured to be moved back and forth across medium 20 along a scan axis 40 while supporting at least one ink cartridge or print cartridge. In the particular embodiment illustrated, carriage 30 includes print cartridge locations 42, 44 and 46. Print cartridge locations 42, 44 and 46 generally comprise structures along carriage 30 that are configured to hold or retain an individual print cartridge. Print cartridge locations 42, 44 and 46 are configured such that each of print cartridges 24, 26 and 28 is interchangeable with one another. Carriage 30 may alternatively be configured to specifically support a particular one of print cartridges 24, 26 and 28. The exact configuration of such print cartridge locations may be varied depending upon the exact configuration of the ink print cartridge to be held or retained at the print cartridge location, as well as the type of connecting or supporting arrangement employed at each print cartridge location.

Carriage drive 32 is shown schematically and generally comprises a conventionally known or future developed actuator configured to move carriage 30 along scan axis 40 across medium 20 in response to control signals from controller 36. Media drive 34, schematically shown, comprises a conventionally known or future developed actuator configured to feed and move medium 20 relative to carriage 30 and whatever print cartridges are supported at print cartridge locations 42, 44 and 46. The exact configuration of media drive 34 may be varied depending upon the characteristics of medium 20 being fed past carriage 30. For example, media drive 34 may have different configurations depending upon whether medium 20 is provided as a roll or as individual sheets, and depending upon the particular dimensions of medium 20. U.S. Pat. No. 5,659,345 by Altendorf and issued on Aug. 19, 1997, the full disclosure of which is hereby incorporated by reference, describes examples of a carriage drive 32 and a media drive 34.

Controller 36 generally comprises a processor unit configured to generate control signals which are transmitted to carriage drive 32, media drive 34 and whatever print cartridges 24, 26, 28 that are mounted to carriage 30. Controller 36 may comprise a conventionally known or future developed processing unit that executes sequences of instructions contained in a memory (not shown). Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. Controller 36 is not limited to any specific combination of hardware circuitry and software, nor to any particular source for the instructions executed by the processing unit.

Controller 36 receives data representing an image to be printed from a source (not shown) such as a computer, a portable memory storage device such as flash memory, disk, cassette, card and the like, or directly from memory of a device, such as a video camera, digital camera and the like. Controller 36 further senses the characteristics and locations of print cartridges 24, 26, 28 or other print cartridges mounted to carriage 30. Based upon such information, controller 36 controls carriage drive 32 to move carriage along scan axis 40, controls media drive 34 to move medium 20 relative to carriage 30 in directions generally perpendicular to scan axis 40, and controls the application of inks from one or more of print cartridges 24, 26, 28, 14 or 16 supported by carriage 30.

Print cartridges 24, 26 and 28 (schematically shown) are substantially identical to one another, except for different inks or ink combinations contained within the print cartridges. In particular, each of print cartridges 24, 26 and 28 generally comprise a conventionally known or future developed inkjet print cartridge having a printhead 50 and a plurality of distinct chambers 52 which communicate with the printhead 50. Printhead 50 includes a plurality of individual nozzles, wherein each chamber 52 is in communication with one or more of the plurality of nozzles. Based upon control signals from controller 36, ink is dispensed from the chambers 52 through the nozzles 50 onto print medium 20. In the particular embodiment illustrated, each of print cartridges 24, 26 and 28 includes three chambers 52 in communication with printhead 50. An example of a three chambered ink jet print cartridge that may be employed is disclosed in U.S. Pat. No. 5,969,739 by Altendorf et al. which issued on Oct. 19, 1999, the full disclosure of which is hereby incorporated by reference. As will be described in greater detail hereafter, the three chambers provided by each of print cartridges 24, 26 and 28 enables printer system 12 to utilize unique ink combinations for improved image reproduction quality and for printing unique modes.

Print cartridge 24 includes three chromatic inks contained within its three chambers 52. In the embodiment illustrated, print cartridge 24 includes a dark cyan ink (C), a dark magenta ink (M) and a yellow ink (Y). Print cartridge 26 includes a light cyan ink (c), a light magenta ink (m) and a pigment black ink (k) in its three chambers 52.

For purposes of this disclosure, "dark" and "light" inks are to be identified based upon their light absorbance. Absorbance is generally used to determine the concentration of a given substance such as a dye in a solution. Many molecules and ions have the ability to absorb visible light. When such ions or molecules are present in the solution, the amount of light absorbed is directly related to the number of molecules in solution. Each ion or molecule has a characteristic absorption spectra wherein the various wave lengths of light present in visible "white" light are differentially absorbed. It is generally desirable in most cases to measure the absorbance where the absorbance is strongest (LAMBDAMAX) or most sensitive. The absorbance of an ink is measured on a sample of the ink diluted one part in 10,000 at a point of maximum peak absorbance (LAMBDAMAX) within a given wave length range.

Accordingly, Beers Law:

Absorbance=Ebc where

E is equal to molar absorptivity or extinction coefficient which is an intrinsic property of the molecule b is equal to the path length the light must travel through the sample c is equal to the solution concentration may be applied to determine the concentration of dye molecules. Applying this measurement, the "light" and "dark" inks possess the following absorbance values:

| Ink | Absorbance range | Wavelength range | Dilution |
|---|---|---|---|
| Dark Cyan | .07 to .4 | 600 to 700 | 1 to 10,000 |
| Light Cyan | .001 to .0699 | 600 to 700 | 1 to 10,000 |
| Dark Magenta | .05 to .4 | 500 to 599 | 1 to 10,000 |
| Light Magenta | .001 to .0499 | 500 to 599 | 1 to 10,000 |
| Yellow | .05 to .4 | 350 to 499 | 1 to 10,000 |
| Light Yellow | .001 to .0499 | 350 to 499 | 1 to 10,000 |

Print cartridge 28 includes three achromatic inks within its three chambers 52, wherein the three achromatic inks have distinct L* values. For purposes of this disclosure, an "achromatic" ink shall mean an ink having a small or visually negligible amount of chroma. For purposes of this disclosure, the term "L* value" refers to the CIE 76 L* values which are determined based upon standards relating to perceptual lightness promulgated by the International Committee on Illumination or CIE (Commission Internationale de L'Eclairage) in 1976. According to such standards, an L* value of 100 generally equals an ideal diffused perfectly white reflector. In the particular embodiment illustrated, print cartridge 28 includes a light gray ink (g), a medium gray ink (G) and a dye-based black ink (Z). In the embodiment shown, the light gray ink (g) has a first L* value, the medium gray ink (G) has a second smaller L* value, and the dye-based black ink has a third L* value less than the first L* value of the light gray ink and less than the second L* value of the medium gray ink. The light gray ink has an L* value greater than or equal to the L* value of the light cyan ink and the light magenta ink. In one embodiment, the light gray ink has an L* value of between about 50 and 70, the medium gray ink has an L* value of between about 25 and 50, and the dye-based black ink has an L* value of between about 0 and 5. By way of comparison, dark cyan (C) ink and dark magenta (M) ink typically have an L* value of between about 35 and 55 while light cyan (c) ink and light magenta (m) ink have L* values of between about 60 and 85. In particular applications, the L* values of the achromatic inks contained in print cartridge 28 may slightly vary depending upon the L* value of the medium 20 being printed upon. In particular, in applications where medium 20 has a first L* value (L*1) and where the dye-based black ink has an L* value of less than the first L* value by a difference D, the dark gray ink may have an L* value of between L*1 minus 0.5 D and L*1 minus 0.75 D. The light gray ink may have an L* value of between L*1 minus 0.3 D and L*1 minus 0.5 D.

The light gray (g) ink, the medium gray (G) ink and the dye-based black (Z) ink may also be identified by their absorbance values. However, unlike chromatic colors, achromatic colors typically have a flat response rather than a peak absorbance. As a result, the wave length range where such peak absorbance occurs is much broader. Applying the Beers Law of Measurement, the black (Z) ink, medium gray (G) ink and light gray (g) inks have the following absorbance values:

| Ink | Absorbance range | Wavelength range | Dilution |
|---|---|---|---|
| Black | .1 to .8 | 350 to 750 | 1 to 10,000 |
| Medium Gray | .03 to .0999 | 350 to 750 | 1 to 10,000 |
| Light Gray | .001 to .0299 | 350 to 750 | 1 to 10,000 |

In contrast to conventional printing systems that combine a yellow ink (Y) contained in a first print cartridge with a light cyan ink (c) or a light magenta ink (m) contained in a second print cartridge to produce a composite gray (i.e. a gray color created by printing a plurality of different chromatic ink dots in close proximity to one another, a technique commonly referred to as halftoning), printer system 12 utilizes a single print cartridge 28 providing a plurality of achromatic inks having distinct L* values such as light gray ink (g), medium gray ink (G) and dye-based black ink (Z). As a result, printer system 12 prints images with (1) greater consistently, (2) improved economy and (3) higher quality. First, in contrast to those systems that print composite grays, printing system 12 may print more consistent images that are less likely to experience hue shift. In particular, it has been found that images printed by printing system 12 using print cartridge 28 do not experience hue shift in conditions where dot grain varies such as when different media is used or such as when humidity changes. In other words, printing system 12 achieves results that are consistent regardless of the type of media being printed upon or the particular humidity during such printing. In addition, because each of the three achromatic inks utilized by system 12 are contained in a single print cartridge 28, images printed by system 12 do not experience hue shift which occurs when different print cartridges produce differently sized drops of ink given the same electrical signals as a result of manufacturing tolerances (also known as "pen drop weight variation").

Moreover, unlike those systems that must print composite grays, system 12 and print cartridge 28 prints images having reduced metamerism effects that result in color shifts under different illuminants. For example, grays produced by system 12 utilizing print cartridge 28 do not look purple under office lights but green under daylight.

Second, printing system 12 enables more efficient and economical use of ink. In conventional systems, each composite gray that is printed typically requires the yellow ink (Y), resulting in excessive consumption of such yellow ink. Because system 12 prints grays utilizing print cartridge 28, system 12 achieves more balanced usage of inks contained within the CMY print cartridge 24 and, ultimately, a longer useful life for the CMY print cartridge.

Third, in contrast to conventional systems which print composite grays, printing system 12 produces higher quality images. In particular, system 12 achieves improved or increased gamut in color images and improved true black-and-white images. As described in greater detail in co-pending U.S. patent application Ser. No. 10/460,891, entitled "RENDERING USING AT LEAST TWO LEVELS OF GRAY", filed on filed on the same date herewith by Jay S. Gondek, Stephen W. Bauer, Matthew A. Shepherd, Guo Lee, and Luann E. J. Rolly, the full disclosure of which is hereby incorporated by reference, transitions from solid colors to black may be defined by utilizing a light gray ink, a medium gray ink and a black ink in combination with not more than two additional colorants. As a result, global hue cast problems in images are eliminated, more accurate color reproduction and less need for printer calibration is achieved, cyan dots in skin colors are eliminated, ink usage is reduced, and grain is reduced. In addition, for a given dot visibility, the gray inks achieve better darkening properties when printed beyond dot-overlap due to uniform absorption. Because of the uniform absorptive properties of the gray ink, the use of gray in conjunction with color inks results in an improved gamut for dark colors. Moreover, utilizing at least two gray inks enables fine gray or black details to be reproduced without color fringing. Similar benefits are achieved when black and white images are being printed.

Printer system 12 also achieves improved photo quality images as compared to those systems that utilize print cartridges containing a single ink and that recommend mounting seven print cartridges (C, M, Y, c, m, k and light black ink print cartridges) to the carriage for photo printing. In particular, because print cartridge 28 includes a light gray ink (g) having an L* value greater than or equal to the L* value of the light cyan ink (c) and the light magenta ink (m), system 12 achieves light tone characteristics in its printed images that are better than those systems employing light cyan and light magenta inks to produce composite grays. At the same time, because system 12 utilizes a print cartridge 28 also including a medium gray ink (G) having an L* value between the L* value of the black ink and the L* value of the light gray ink, system 12 also achieves a smooth transition between the light gray ink (g) and the black ink (k) without a noticeable increase in grain in midtones in image 18. Because print cartridge 28 includes two gray inks, g, G, in addition to a black ink, Z, print cartridge 28 may utilize a light gray having an L* value greater than the L* value of typical light cyan (c) and light magenta (m) inks and a medium gray ink having an L* value greater than a typical dark cyan (C) or dark magenta (M) inks. Because print cartridge 28 utilizes balanced gray inks, system 28 may produce a lighter dot utilizing the light gray ink as compared to the light cyan ink or the light magenta ink. Similarly, system 12 may also produce a lighter dot using the medium gray ink as compared to those prior systems which utilize dark cyan ink or dark magenta inks. The end result is less grain in light regions as well as less grain in mid-tone regions.

As further shown by FIG. 1, printer kit 10 additionally includes ink print cartridges 14 and 16. Ink print cartridges 14 and 16 are configured to be interchangeable with at least one of print cartridges 24, 26 and 28 at print cartridge locations 42, 44 and 46 of carriage 30. Print cartridge 14 is substantially identical to print cartridges 24, 26 and 28 except for the ink contained therein. In particular, print cartridge 14 generally comprises a conventionally known or future developed ink cartridge or print cartridge having a printhead 50 and a plurality of chambers 52 in communication with printhead 50. In the particular embodiment illustrated, print cartridge 14 contains a light cyan ink (c), a light magenta ink (m) and a light yellow ink (y) in three distinct chambers 52 (schematically shown as being separated by dashed lines). In one particular application, print cartridge 26 is interchanged with print cartridge 44. Like print cartridge 26, print cartridge 14 facilitates printing of high quality color photo images when used by system 12 in conjunction with print cartridges 24 and 28. At the same time, print cartridge 14 also enables system 12 to print various artistic effects in an image. In particular, controller 36 may be configured to utilize inks from print cartridge 14 (c, m, y) in combination with inks from print cartridge 28 (g, G, z) to create gray scale artistic effects. In addition, controller 36 may also be configured to create color cast effects using print cartridges 26 and 28 such as sepia or blue-toned images. In still other applications, controller 36 may be configured to utilize print cartridges 26 and 28 in combination with one another to achieve variable color washes over elements in a black-and-white image. One example is a "faux" hand-colored mode that simulates hand-colored photos. In lieu of controller 36 being configured to generate control signals for controlling the application of ink by print cartridges 24, 14 and 28 to add such artistic effects to existing image data, the image data itself provided to controller 36 may be pre-modified to include such artistic effects, wherein controller 36 utilizes print cartridges 26 and 28 to print an image as defined by the pre-modified image data.

Print cartridge 16 generally comprises a conventionally known or future developed inkjet cartridge or print cartridge having a printhead 50 in a single chamber 52 containing a black pigment ink. As conventionally known, black pigment ink is particularly useful for printing text. In particular applications where image 18 consists solely of text, print cartridge 16 may be exchanged with one of print cartridges 24, 26, 28 (or 14) mounted to carriage 30.

In one alternative embodiment, print cartridge 28 includes two achromatic inks and a chromatic ink within its three chambers 52. For example, in one embodiment, print cartridge 28 may include a light gray (g) ink and a medium gray (G) ink as, discussed above, but may alternatively include a color or chromatic ink in lieu of the dye-based black (Z) ink. In still other embodiments, print cartridge 28 may alternatively include only two chambers 52 containing the light gray (g) ink and the medium gray (G) ink discussed above. In such alternative embodiments, provision of a light gray ink and a medium gray ink in a single print cartridge achieves high image quality and versatile printing capabilities.

Figure 2:
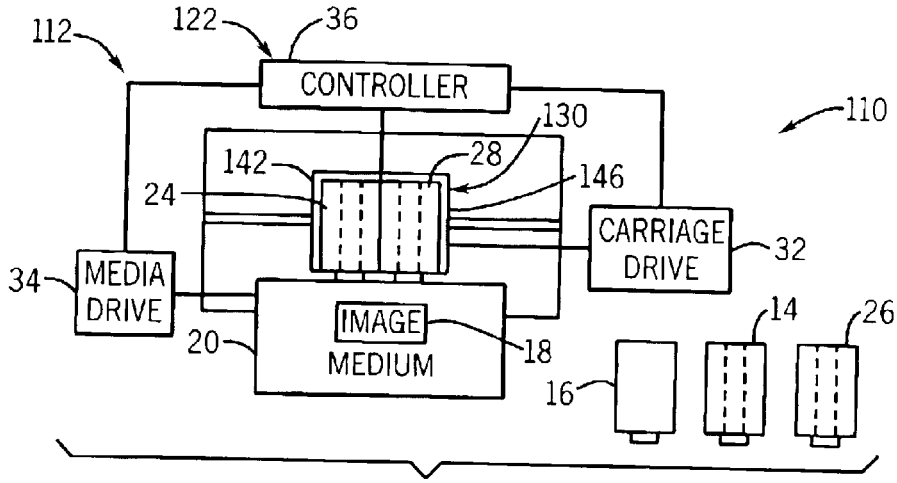
FIG. 2 is a schematic illustration of another embodiment of the printer kit and printing system of FIG. 1.
Figure 3:
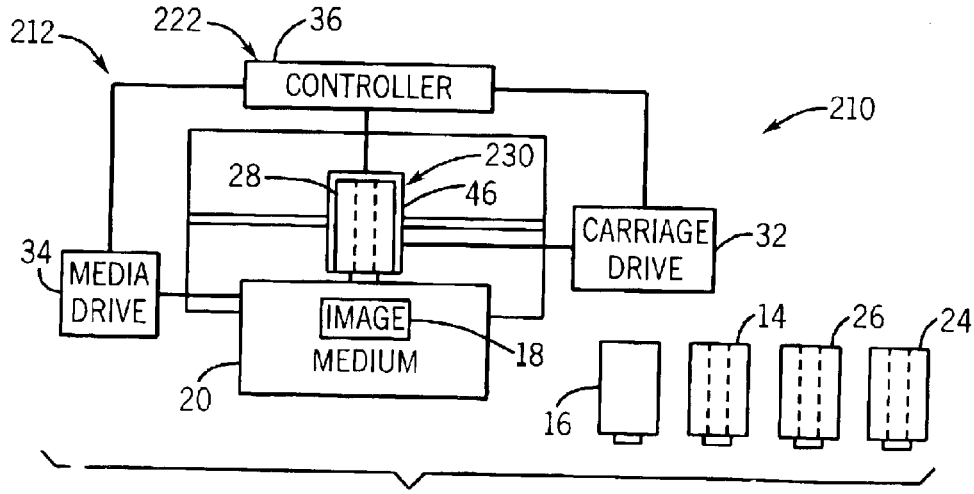
FIG. 3 is a schematic illustration of yet another embodiment of the printer kit and printing system of FIG. 1.

FIGS. 2 and 3 depict alternative embodiments of printer kit 10 while highlighting the greater versatility, convenience and cost savings resulting from print cartridge 28. FIG. 2 schematically illustrates printer kit 110, a first alternative embodiment of kit 10. Kit 10 generally includes printing system 112 and print cartridges 14, 16 and 26, in addition to those print cartridges already mounted to carriage 30 and provided as part of system 112. System 112 is substantially identical to system 12 except that system 112 includes printer 122 having carriage 130 in lieu of printer 22. Carriage 130 includes two print cartridge locations 142, 146 which are configured to support two print cartridges 24 and 28 relative to medium 20. Those remaining components of system 112 which correspond to components of system 12 are numbered similarly. Because printer 122 of system 112 includes carriage 130 which has only two print cartridge locations 142, 146, printer 122 is generally smaller, more compact and less expensive to manufacture. At the same time, however, because system 112 includes print cartridge 28, system 112 has greater printing versatility as compared to previously known systems having printers with only two print cartridge locations. In the arrangement shown, print cartridges 24 and 28 are mounted or otherwise coupled to carriage 130 at print cartridge locations 142 and 146, respectively. With this arrangement, system 112 is capable of printing either color photo images 18 or black and white images 18 without the need to swap or exchange print cartridges supported by carriage 130. In particular, print cartridges 24 and 28 are both used for color photo printing while print cartridge 28, by itself, is sufficient to print to high-quality black-and-white photos. Those color photo images 18 utilizing both print cartridges 24 and 28 have reduced grain, less color cast and a darker photo black as compared to images generated by prior printers having two print cartridge locations that supported a CMY print cartridge and a cmk print cartridge.

Adding to the versatility of system 112, kit 110 enables one or more of print cartridges 14, 16 and 26 to be swapped with print cartridges 24 and 28 for printing even additional types of print or effects. For example, print cartridge 14 may be simply switched with print cartridge 24 to print artistic effects by utilizing ink from both print cartridges 14 and 28. Examples of such artistic effects include overall color cast effects like sepia or blue-toned images, or variable color washes over elements in a black-and-white image. One example of a color was is a "faux" hand-colored mode that simulates hand-colored photos. By swapping print cartridges 16 and 24, the pigment black ink contained in print cartridge 16 may be utilized in conjunction with three achromatic dye-based inks in print cartridge 28 to achieve extremely high-quality black-and-white printing on media type such as plain paper that require pigment black to achieve a sufficiently dark black image. In such a configuration, combinations of the three achromatic dye-based inks are half-toned together to form gray highlights and mid-tones and the pigment black is half-toned into the mix for darker tones and black.

Overall, kit 110 achieves much higher quality black-and-white photo printing and color photo printing while utilizing a more compact and generally less expensive two-print cartridge printer 122 having a carriage 130 with only two print cartridge locations 142 and 146. Although kit 110 is illustrated as including print cartridges 14, 16, 24, 26 and 28, kit 110 may alternatively include fewer than all five print cartridges so long as kit 110 includes print cartridge 28 which provides printing system 112 with its printing versatility.

FIG. 3 is a schematic illustration of printer kit 210, a second alternative embodiment of printer kit 10. Printer kit 210 is similar to printer kit 10, except that printer kit 210 includes printing system 212 including printer 222 in lieu of printing system 12 and printer 22. For ease of illustration, those remaining components of printer kit 210 which correspond to those components of printer kit 10 are numbered similarly. Printer 222 is similar to printer 22, except that printer 222 includes carriage 230 having a single print cartridge location 46. Because printer 222 includes carriage 230 having a single print cartridge location 46, printer 222 is more compact in size and is generally less complex and less expensive. At the same time, however, because kit 210 includes print cartridge 28, kit 210 is extremely versatile. In particular, when print cartridge 28 is coupled to carriage 230, printing system 212 prints high-quality black-and-white photo images. By merely swapping print cartridge 24 with print cartridge 28, an individual can convert printing system 212 for printing color photo images. Likewise, by swapping print cartridge 16 with print cartridge 28 (or print cartridge 24), an individual can convert printing system 212 for printing pure black-and-white text using pigment black ink. In sum, because kit 210 includes print cartridge 28, kit 210 can be easily and conveniently modified simply by switching print cartridges to print either color or black-and-white photo images. Although kit 210 is illustrated as including print cartridges 14, 16, 24, 26 and 28, kit 210 may alternatively include a fewer number of such print cartridges so long as kit 210 includes print cartridge 28 which facilitates such printing versatility.

Although the present invention has been described with reference to example embodiments, workers skilled in the art will recognize that changes may be made in form and detail without departing from the spirit and scope of the invention. For example, although different example embodiments may have been described as including one or more features providing one or more benefits, it is contemplated that the described features may be interchanged with one another or alternatively be combined with one another in the described example embodiments or in other alternative embodiments. Because the technology of the present invention is relatively complex, not all changes in the technology are foreseeable. The present invention described with reference to the example embodiments and set forth in the following claims is manifestly intended to be as broad as possible. For example, unless specifically otherwise noted, the claims reciting a single particular element also encompass a plurality of such particular elements.

What is claimed is:

1. A printing system comprising:

a printer including a carriage configured to move across the medium;

a first print cartridge releasably coupled to the carriage, the first print cartridge including:

a first printhead; and at least three achromatic inks having distinct L* values and contained within at least three chambers in communication with the first printhead; and a second print cartridge releasably coupled to the carriage, the second print cartridge including:

a second printhead; and a plurality of chromatic inks including cyan and magenta inks contained within a plurality of chambers in communication with the second printhead.

2. The system of claim 1, wherein the printer is configured to print upon a medium having a first L* value (L*1) and wherein the at least three achromatic inks includes:

a first achromatic ink having a second L* value less than the first L* value by a difference D;

a second achromatic ink having an L* value of between L*1 minus 0.5 D and L*1 minus 0.75 D;

a third achromatic ink having an L* value of between L*1 minus 0.3 D and L*1 minus 0.5 D.

3. The system of claim 2, wherein the first ink is a dye-based ink.

4. The system of claim 1, wherein the plurality of chromatic inks includes a dark cyan ink, a dark magenta ink and a dark yellow ink contained in three chambers.

5. The system of claim 1, wherein the plurality of chromatic inks includes a light cyan ink and a light magenta ink contained in first and second chambers, respectively, in communication with the second printhead.

6. The system of claim 5, wherein the plurality of chromatic inks includes light yellow ink contained in a third chamber in communication with the second printhead.

7. The system of claim 5, wherein the light cyan ink has a first L* value, wherein the light magenta ink has a second L* value, and wherein the at least three achromatic inks includes a first achromatic ink having a third L* value greater than both the first L* value and the second L* value.

8. The system of claim 7, further including a third print cartridge releasably coupled to the carriage, the third print cartridge including a third printhead;

a dark cyan ink contained with a first chamber of the third print cartridge in communication with the third printhead; and a dark magenta ink contained within a second chamber of the third print cartridge in communication with the third printhead, wherein the dark cyan ink has a fourth L* value, wherein the magenta ink has a fifth L* value, and wherein the plurality of achromatic inks includes a second achromatic ink having a sixth L* value greater than the fourth L* value and the fifth L* value and less than the third L* value.

9. The system of claim 1, wherein the first print cartridge and the second print cartridge are configured to be interchangeably coupled to a single print cartridge location on the carriage.

10. The system of claim 1 including a third print cartridge releasably coupled to the carriage and including:

a third printhead; and a black ink contained within a chamber in communication with the third printhead.

11. The system of claim 10, wherein the black ink is a pigment-based ink.

12. The system of claim 10, wherein the first print cartridge and the third print cartridge are configured to be interchangeably coupled to a single location on the carriage.

13. The system of claim 1, wherein the at least three achromatic inks having distinct L* values includes a light gray ink, a medium gray ink and a black ink.

14. The system of claim 13, wherein the light gray ink has a L* value of between about 50 and 70, wherein the medium gray ink has an L* value of between about 25 and 50, and wherein the black ink has an L* value of between about 0 and 5.

15. The system of claim 13, wherein the light gray ink has an L* value of about 60, wherein the medium gray ink has an L* value of about 35 and wherein the black ink has an L* value of about 5.

16. The system of claim 1, wherein the plurality of chromatic inks includes a dark cyan ink, a dark magenta ink and a dark yellow ink contained within a first chamber, a second chamber and a third chamber, respectively, of the plurality of chambers of the second print cartridge and wherein the kit further includes a third print cartridge including:

a third printhead;

a light cyan ink contained within a fourth chamber in communication with the third printhead;

a light magenta ink contained within a fifth chamber in communication with the third printhead; and a light yellow ink contained within a sixth chamber in communication with the third printhead.

17. A printer kit comprising:

a printer including a carriage configured to move across the medium, the carriage having a first print cartridge location;

a first print cartridge including:

a first printhead; and a plurality of distinct chromatic inks including cyan and magenta inks contained within a plurality of distinct chambers in communication with the first printhead; and a second print cartridge including:

a second printhead; and at least three achromatic inks having distinct L* values contained within at least three corresponding chambers in communication with the second printhead, wherein the first print cartridge and the second print cartridge are configured to be interchangeably coupled to the first print cartridge location.

18. The kit of claim 17, wherein the plurality of chromatic inks includes a dark cyan ink, a dark magenta ink and a dark yellow ink.

19. The kit of claim 17, wherein the plurality of chromatic inks includes a light cyan ink contained in a first chamber and a light magenta ink contained in a second chamber.

20. The kit of claim 19, wherein the second print cartridge additionally includes a light yellow ink contained in a third chamber.

21. The kit of claim 20, wherein the second print cartridge additionally includes a black ink contained in a third chamber.

22. The kit of claim 17, wherein the at least three achromatic inks include a light gray ink, a medium gray ink and a black ink.

23. The kit of claim 17, wherein the media drive is configured to move a medium having a first L* value (L*1) and wherein the at least three achromatic inks include:

a first black ink having a second L* value less than the first L* value by a difference D;

a second ink comprising a first dark gray ink having an L* value of between L*1 minus 0.5 D and L*1 minus 0.75 D;

a third ink comprising a light gray ink having an L* value of between L*1 minus 0.3 D and L*1 minus 0.5 D.

24. The kit of claim 23, wherein the black ink is a dye-based ink.

25. The kit of claim 17, wherein the plurality of chromatic inks includes a dark cyan ink, a dark magenta ink and a dark yellow ink contained within a first chamber, a second chamber and a third chamber, respectively, of the plurality of chambers of the first print cartridge and wherein the kit further includes a third print cartridge including:

a third printhead;

a light cyan ink contained within a first chamber of the third print cartridge in communication with the third printhead;

a light magenta ink contained within a second chamber of the third print cartridge in communication with the third printhead; and a black ink contained within a third chamber of the third print cartridge in communication with the third printhead.

26. The kit of claim 25, wherein the light magenta ink has a first L* value, wherein the light cyan ink has a second L* value, and wherein the at least three achromatic inks includes a first achromatic ink having a third L* value greater than the first L* value and the second L* value.

27. The kit of claim 26, wherein the dark cyan ink has a fourth L* value, wherein the dark magenta ink has a fifth L* value, wherein the at least three achromatic inks includes a second achromatic ink having a sixth L* value greater than the fourth L* value and the fifth L* value and less than either the first L* value or the second L* value.

28. The kit of claim 25, wherein the dark cyan ink has a first L* value, wherein the dark magenta ink has a second L* value, and wherein the at least three achromatic inks includes a first achromatic ink having an L* value greater than the first L* value and the second L* value, and a second achromatic ink having an L* value of less than the first L* value and the second L* value.

29. The kit of claim 17, wherein the plurality of chromatic inks includes a dark cyan ink, a dark magenta ink and a dark yellow ink contained within a first chamber, a second chamber and a third chamber, respectively, of the plurality of distinct chambers and wherein the kit further includes a third print cartridge including:

a third printhead;

a light cyan ink contained within a first chamber of the third print cartridge in communication with the third printhead;

a light magenta ink contained within a second chamber of the third print cartridge in communication with the third printhead; and a light yellow ink contained within a third chamber of the third print cartridge in communication with the third printhead.

30. The kit of claim 29, including a fourth print cartridge including:

a fourth printhead; and a pigment-based black ink contained within a chamber of the fourth print cartridge in communication with the fourth printhead.

31. The kit of claim 29, wherein the carriage includes a second print cartridge location configured to receive the second print cartridge and a third print cartridge location configured to receive the third print cartridge.

32. The kit of claim 17, wherein the at least three achromatic inks includes a first achromatic ink having a first L* value of between about 25 and 50; and a second achromatic ink having a second L* value of between about 50 and 70.

33. The kit of claim 17, including a third print cartridge including:

a third printhead; and a black ink contained within a chamber of the third print cartridge in communication with the third printhead.

34. The kit of claim 33, wherein the carriage includes a second print cartridge location configured to receive the second print cartridge and a third print cartridge location configured to receive the third print cartridge.

35. The kit of claim 17, wherein the carriage includes a second print cartridge location configured to receive the second print cartridge.

36. The kit of claim 17, wherein the plurality of chromatic inks includes a light cyan ink contained in a first chamber, a light magenta ink contained in a second chamber and a light yellow ink contained in a third chamber.

37. A method for printing an image upon a medium using a printer having a carriage and at least one print cartridge location along the carriage, the method comprising:

coupling a first print cartridge containing a first set of distinct chromatic inks to a first print cartridge location along the carriage;

coupling a second print cartridge containing a second set of distinct chromatic inks, each ink of the second set corresponding to an ink of the first set but having a higher L* value;

coupling a third print cartridge containing at least three achromatic inks having distinct L* values to a third print cartridge location along the carriage; and depositing at least one ink from at least one of the first print cartridge, the second print cartridge and the third print cartridge upon a print medium.

38. The method of claim 37, wherein the depositing step consists of depositing at least one ink from the second print cartridge upon the medium and depositing at least one ink from the third print cartridge upon the medium.

39. The method of claim 37, wherein the first set of chromatic inks includes a dark cyan ink, a dark magenta ink and a dark yellow ink and wherein the second set of chromatic inks includes a light cyan ink, a light magenta ink and a light yellow ink.

40. The method of claim 37, wherein the depositing step consists solely of depositing at least one ink from the third print cartridge upon the medium.

41. The method of claim 37, wherein the depositing step includes:

depositing at least one ink from the third print cartridge upon the medium; and depositing no more than two inks from at least one of the first print cartridge and the second print cartridge upon the medium at a same location upon the medium.

42. A printing system including:

a printer having:

a media drive configured to move a medium; and a carriage configured to move across the medium, the carriage including a sole print cartridge location;

a first print cartridge configured to be releasably coupled to the sole print cartridge location of the carriage, the first print cartridge including:

a first printhead; and at least three achromatic inks having distinct L* values contained within at least three distinct chambers in communication with the first printhead; and a second print cartridge configured to be releasably coupled to the sole print cartridge location of the carriage, the second print cartridge including:

a second printhead; and a plurality of chromatic inks including cyan and magenta inks contained within a plurality of distinct chambers in communication with the second printhead, wherein the first print cartridge and the second print cartridge may be interchanged with one another to print different modes of an image upon the medium.

43. The system of claim 42, wherein the at least three achromatic inks includes:

a first ink having an L* value of between about 0 and 5;

a second ink having an L* value of between about 25 and 50; and a third ink having a third L* value of between about 50 and 75.

44. The system of claim 42, wherein the plurality of chromatic inks includes:

a light cyan ink contained in a first chamber; and a light magenta ink contained in a second chamber of the plurality of chambers.

45. The system of claim 44, wherein the plurality of chromatic inks includes a light yellow ink contained within a third chamber of the plurality of chambers.

46. The system of claim 44 including a black ink contained within a third chamber.

47. The system of claim 42, wherein the plurality of chromatic inks includes:

a dark cyan ink contained within a first chamber of the plurality of chambers;

a dark magenta ink contained within a second chamber of the plurality of chambers; and a dark yellow ink contained within a third chamber of the plurality of chambers.

48. A method for printing an image upon a medium using a printer having a carriage and at least one print cartridge location along the carriage, the method comprising:

coupling a first print cartridge containing at least three achromatic inks having distinct L* values to a first print cartridge location along the carriage;

depositing the at least achromatic inks upon a print medium;

coupling a second print cartridge containing a plurality of chromatic inks including cyan and magenta inks to a second print cartridge location along the carriage; and depositing at least one ink from the second print cartridge upon the print medium.

49. The method of claim 48, wherein the second print cartridge contains a dark cyan ink, a dark magenta ink and a dark yellow ink.

50. The method of claim 48, wherein the second print cartridge contains a light cyan ink and a light magenta.

51. The method of claim 50, wherein the second print cartridge additionally contains a light yellow ink.

52. A printing system comprising:

a printer including a carriage configured to move across the medium; and a first print cartridge releasably coupled to the carriage, the first print cartridge including:

a first printhead;

a plurality of achromatic dye-based inks having distinct L* values contained within a plurality of chambers in communication with the first printhead;

a second print cartridge releasably coupled to the carriage, the second print cartridge including:

a second printhead; and a plurality of chromatic inks including cyan ink and magenta inks contained within a plurality of chambers in communication with the second printhead.

53. The system of claim 52, wherein the plurality of achromatic dye-based inks includes a light gray ink and a medium gray ink.

54. The system of claim 52, wherein the plurality of achromatic inks includes:

a first ink having an L* value of between about 50 and 70; and a second ink having an L* value of between about 25 and 50.

55. A printing system for printing upon a medium, the printing system comprising:

a first printhead;

a second printhead:

means for moving at least one of the first and second printheads and the medium relative to one another; and means for supplying a plurality of achromatic dye-based inks having distinct L* values to the first printhead; and means for supplying a plurality of chromatic inks including cyan and magenta inks to the second printhead.

56. The system of claim 55, wherein the means for supplying includes means for simultaneously transporting the plurality of achromatic dye-based inks.

57. A printing system comprising:

a printer including a carriage configured to move across the medium; and a first print cartridge releasably coupled to the carriage, the first print cartridge including:

a first printhead; and a plurality of distinct achromatic inks contained within a plurality of chambers in communication with the first printhead, wherein the plurality of achromatic inks includes:

a first ink having a first absorbance of between about 0.03 and 0.0999; and a second ink having a second absorbance of between about 0.001 and 0.0299, wherein the first absorbance and the second absorbance are measured using a wavelength range of between 350 and 750 and a dilution of 1 to 10,000.

58. The system of claim 57, wherein the plurality of achromatic inks further includes a third ink having a third absorbance of between about 0.1 and 0.8 measured using a wavelength range of between about 350 and 750 dilution of 1 to 10,000.

59. The system of claim 57, wherein the plurality of distinct achromatic inks are dye-based inks.

60. The system of claim 57, wherein the plurality of distinct achromatic inks includes:

a first ink having a first absorbance of between about 0.1 and 0.8; and a second ink having a second absorbance of between about 0.03 and 0.0999, wherein the first absorbance and the second absorbance are measured using a wavelength of between 350 and 750 and a dilution of 1 to 10,000.

61. The system of claim 57, wherein the plurality of distinct achromatic inks includes:

a first ink having a first absorbance of between about 0.1 and 0.8; and a second ink having a second absorbance of between about 0.001 and 0.0299, wherein the first absorbance and the second absorbance are measured using a wavelength of between 350 and 750 and a dilution of 1 to 10,000.

62. The system of claim 57, wherein the plurality of distinct achromatic inks includes at least three achromatic inks.

63. The system of claim 57, wherein the plurality of achromatic inks includes:

a first ink having an L* value of between about 50 and 70; and;

a second ink having an L* value of between about 25 and 50.

64. The system of claim 57 including a second print cartridge releasably coupled to the carriage, the second print cartridge including:

a second printhead; and a plurality of chromatic inks contained within a plurality of chambers in communication with the second printhead.

65. A printing system comprising:

a printer including a carriage configured to move across the medium; and a first print cartridge releasably coupled to the carriage, the first print cartridge including:

a first printhead; and at least three achromatic inks having distinct L* values and contained within at least three chambers in communication with the first printhead, wherein the printer is configured to print upon a medium having a first L* value (L*1) and wherein the at least three achromatic inks includes:

a first achromatic ink having a second L* value less than the first L* value by a difference D;

a second achromatic ink having an L* value of between L*1 minus 0.5 D and L*1 minus 0.75 D;

a third achromatic ink having an L* value of between L*1 minus 0.3 D and L*1 minus 0.5 D.

66. A printing system comprising:

a printer including a carriage configured to move across the medium;

a first print cartridge releasably coupled to the carriage, the first print cartridge including:

a first printhead; and at least three achromatic inks having distinct L* values and contained within at least three chambers in communication with the first printhead; and a second print cartridge releasably coupled to the carriage, the second print cartridge including:

a second printhead; and a plurality of chromatic inks contained within a plurality of chambers in communication with the second printhead, wherein the plurality of chromatic inks includes a light cyan ink and a light magenta ink contained in first and second chambers, respectively, in communication with the second printhead, wherein the light cyan ink has a first L* value, wherein the light magenta ink has a second L* value, and wherein the at least three achromatic inks includes a first achromatic ink having a third L* value greater than both the first L* value and the second L* value.

67. The system of claim 66, further including a third print cartridge releasably coupled to the carriage, the third print cartridge including:

a third printhead;

a dark cyan ink contained with a first chamber of the third print cartridge in communication with the third printhead; and a dark magenta ink contained within a second chamber of the third print cartridge in communication with the third printhead, wherein the dark cyan ink has a fourth L* value, wherein the magenta ink has a fifth L* value, and wherein the plurality of achromatic inks includes a second achromatic ink having a sixth L* value greater than the fourth L* value and the fifth L* value and less than the third L* value.

68. A printer kit comprising:

a printer including a carriage configured to move across the medium, the carriage having a first print cartridge location;

a first print cartridge including:

a first printhead; and a plurality of distinct chromatic inks contained within a plurality of distinct chambers in communication with the first printhead; and a second print cartridge including:

a second printhead; and at least three achromatic inks having distinct L* values contained within at least three corresponding chambers in communication with the second printhead, wherein the first print cartridge and the second print cartridge are configured to be interchangeably coupled to the first print cartridge location, wherein the media drive is configured to move a medium having a first L* value (L*1) and wherein the at least three achromatic inks include:

a first black ink having a second L* value less than the first L* value by a difference D;

a second ink comprising a first dark gray ink having an L* value of between L*1 minus 0.5 D and L*1 minus 0.75 D; and a third ink comprising a light gray ink having an L* value of between L*1 minus 0.3 D and L*1 minus 0.5 D, wherein the light magenta ink has a first L* value, wherein the light cyan ink has a second L* value, and wherein the at least three achromatic inks includes a first achromatic ink having a third L* value greater than the first L* value and the second L* value.

69. A printer kit comprising:

a printer including a carriage configured to move across the medium, the carriage having a first print cartridge location;

a first print cartridge including:

a first printhead; and a plurality of distinct chromatic inks contained within a plurality of distinct chambers in communication with the first printhead; and a second print cartridge including:

a second printhead; and at least three achromatic inks having distinct L* values contained within at least three corresponding chambers in communication with the second printhead, wherein the first print cartridge and the second print cartridge are configured to be interchangeably coupled to the first print cartridge location, wherein the plurality of chromatic inks includes a dark cyan ink, a dark magenta ink and a dark yellow ink contained within a first chamber, a second chamber and a third chamber, respectively, of the plurality of chambers of the first print cartridge and wherein the kit further includes a third print cartridge including:

a third printhead;

a light cyan ink contained within a first chamber of the third print cartridge in communication with the third printhead;

a light magenta ink contained within a second chamber of the third print cartridge in communication with the third printhead; and a black ink contained within a third chamber of the third print cartridge in communication with the third printhead, wherein the dark cyan ink has a first L* value, wherein the dark magenta ink has a second L* value, and wherein the at least three achromatic inks includes a first achromatic ink having an L* value greater than the first L* value and the second L* value, and a second achromatic ink having an L* value of less than the first L* value and the second L* value.

70. A printer kit comprising:

a printer including a carriage configured to move across the medium, the carriage having a first print cartridge location;

a first print cartridge including:

a first printhead; and a plurality of distinct chromatic inks contained within a plurality of distinct chambers in communication with the first printhead; and a second print cartridge including:

a second printhead; and at least three achromatic inks having distinct L* values contained within at least three corresponding chambers in communication with the second printhead, wherein the first print cartridge and the second print cartridge are configured to be interchangeably coupled to the first print cartridge location, wherein the media drive is configured to move a medium having a first L* value (L*1) and wherein the at least three achromatic inks include:

a first black ink having a second L* value less than the first L* value by a difference D;

a second ink comprising a first dark gray ink having an L* value of between L*1 minus 0.5 D and L*1 minus 0.75 D;

a third ink comprising a light gray ink having an L* value of between L*1 minus 0.3 D and L*1 minus 0.5 D.

71. A printing system comprising:

a printer including a carriage configured to move across the medium; and a first print cartridge releasably coupled to the carnage, the first print cartridge including:

a first printhead; and a plurality of distinct achromatic inks contained within a plurality of chambers in communication with the first printhead wherein the plurality of distinct achromatic inks includes:

a first ink having a first absorbance of between about 0.1 and 0.8; and a second ink having a second absorbance of between about 0.03 and 0.0999, wherein the first absorbance and the second absorbance are measured using a wavelength of between 350 and 750 and a dilution of 1 to 10,000.

72. A printing system comprising:

a printer including a carriage configured to move across the medium; and a first print cartridge releasably coupled to the carriage, the first print cartridge including:

a first printhead; and a plurality of distinct achromatic inks contained within a plurality of chambers, in communication with the first printhead, wherein the plurality of distinct achromatic inks includes:

a first ink having a first absorbance of between about 0.1 and 0.8; and a second ink having a second absorbance of between about 0.001 and 0.0299, wherein the first absorbance and the second absorbance are measured using a wavelength of between 350 and 750 and a dilution of 1 to 10,000.

* * * * *

UNITED STATES PATENT AND TRADEMARK OFFICE

CERTIFICATE OF CORRECTION

PATENT NO. : 6,953,239 B2
APPLICATION NO. : 10/460848
DATED : October 11, 2005
INVENTOR(S) : Jay S. Gondek et al.

It is certified that error appears in the above-identified patent and that said Letters Patent is hereby corrected as shown below:

IN THE CLAIMS

Column 14, Line 30, insert a paragraph break between “and” and “a second ink”

Column 18, Line 17, delete “carnage” and insert therefor --carriage--

Signed and Sealed this

Twentieth Day of May, 2008

JON W. DUDAS
*Director of the United States Patent and Trademark Office*